US006178946B1

(12) United States Patent
Matthews et al.

(10) Patent No.: US 6,178,946 B1
(45) Date of Patent: Jan. 30, 2001

(54) COMPRESSION ENGINE BRAKING SYSTEM

(76) Inventors: Jeff A. Matthews, 4281 Kennedy Dr., Columbus, IN (US) 47203; Jerzi Baginski, 1490 Mapleton Ave., Suffield, CT (US) 06078

( * ) Notice: Under 35 U.S.C. 154(b), the term of this patent shall be extended for 0 days.

(21) Appl. No.: 09/357,598

(22) Filed: Jul. 20, 1999

(30) Foreign Application Priority Data

Jul. 20, 1998 (GB) ..... 9815599

(51) Int. Cl.[7] ..... F02D 13/04
(52) U.S. Cl. ..... 123/322
(58) Field of Search ..... 123/321, 322, 123/90.4, 90.41

(56) References Cited

U.S. PATENT DOCUMENTS

| | | | | |
|---|---|---|---|---|
| 992,089 | * | 5/1911 | Watt | 123/90.39 |
| 1,246,343 | * | 11/1917 | Shadecki | 123/90.39 |
| 1,442,995 | * | 1/1923 | Belden | 123/90.41 |
| 2,047,446 | * | 7/1936 | Taylor | 123/90.22 |
| 3,021,826 | * | 2/1962 | Fezzy et al. | 123/90.41 |
| 4,498,432 | * | 2/1985 | Hara et al. | 123/90.16 |
| 5,645,031 | * | 7/1997 | Meneely | 123/322 |
| 5,720,044 | * | 2/1998 | Faria | 123/90.41 |
| 5,730,102 | * | 3/1998 | Arnold et al. | 123/322 |
| 5,758,620 | * | 6/1998 | Warner | 123/321 |
| 5,996,550 | * | 12/1999 | Israel et al. | 123/322 |

FOREIGN PATENT DOCUMENTS

| | | | | |
|---|---|---|---|---|
| 1962631 | * | 6/1971 | (DE) | 123/90.41 |
| 1017726 | * | 1/1966 | (GB) . | |
| 1565670 | * | 4/1980 | (GB) . | |
| 1566047 | * | 4/1980 | (GB) . | |
| 2066403 | * | 7/1981 | (GB) . | |
| 2102883 | * | 9/1983 | (GB) . | |

* cited by examiner

*Primary Examiner*—Erick Solis

(57) ABSTRACT

A compression engine braking system for an engine is disclosed having two exhaust valves 26*a* and 26*b* per cylinder, a crosshead 28 in contact with both exhaust valves 26*a* and 26*b* and a rocker 30 arranged in the drive train between an exhaust cam and the crosshead 28. One end of the rocker 30 acts on a point on the crosshead 28 lying between the exhaust valves 26*a* and 26*b* and the other end of the rocker is arranged to follow the surface of the exhaust cam. The braking system comprises a hydraulic primary piston 12 arranged in a hydraulic circuit 16 with a secondary cylinder 14 acting on one of the exhaust valves 26*a*. The primary cylinder is biased by a spring away from said other end of the rocker 30 when the compression brake is inactive and is biased by the pressure in the hydraulic circuit 16 to move with the other end of the rocker 30 when the compression brake is active. In the invention, a spring biased lash adjuster is arranged between the rocker 30 and the crosshead 28.

10 Claims, 3 Drawing Sheets

COMPRESSION ENGINE BRAKING SYSTEM

TECHNICAL FIELD

The present invention relates to a compression release engine braking system for a compression ignition or diesel engine.

BACKGROUND OF THE INVENTION

Diesel engines have no inherent braking effect like that experienced with spark ignition engines. The reason is that diesel engines do not have a throttle, which, when closed, causes an increase in intake manifold vacuum to retard the rpm of the engine.

It was first proposed in C. L. Cummins U.S. Pat. No. 3,220,392 to operate a diesel engine in such a manner that the engine produces a retarding effect when the engine is in a motoring condition (fuel to the engine is cut off).

The principle on which the compression relief engine braking system relies is that the energy required by the engine to compress air during the compression stroke is discharged and wasted by opening an exhaust valve at the end of the compression stroke. Since the engine is motoring, the compression stroke is no longer followed by a power stroke so that no energy is generated at any time in the engine cycle. The engine therefore acts as an air pump which discharges the air that it compresses into the exhaust system and thereby uses up the kinetic energy of the vehicle in heating intake air.

The Cummins patent describes a hydraulic mechanism which utilizes the cam motion of a unit injector fuel system to selectively actuate the exhaust valve at top dead center TDC. For engines not utilizing a unit injector fuel system, a lost motion camshaft may be proposed, like the one in Pellizoni U.S. Pat. No. 3,786,792. When this type of lost motion mechanism is applied to an engine with multiple exhaust valves and a floating crosshead, the increased clearances may permit the crosshead to float and become disconnected from the valves.

SUMMARY OF THE INVENTION

The above problems are solved by a compression relief engine braking system for an engine having two exhaust valves per cylinder, a crosshead for actuating both exhaust valves and a rocker arranged in the drive train between an exhaust cam and the crosshead, one end of the rocker acting on a point on the crosshead lying between the exhaust valves and the other end of the rocker being arranged to follow the surface of the exhaust cam. The braking system comprises a hydraulic primary piston arranged in a hydraulic circuit with a secondary cylinder acting on one of the exhaust valves, the primary cylinder being biased by a spring away from said other end of the rocker when the compression brake is inactive and being biased by the pressure in the hydraulic circuit to move with said other end of the rocker when the compression brake is active.

SUMMARY OF THE DRAWINGS

The invention will now be described further, by way of example, with reference to the accompanying drawings, in which.

DESCRIPTION OF THE PREFERRED EMBODYMENT

Figure 1:
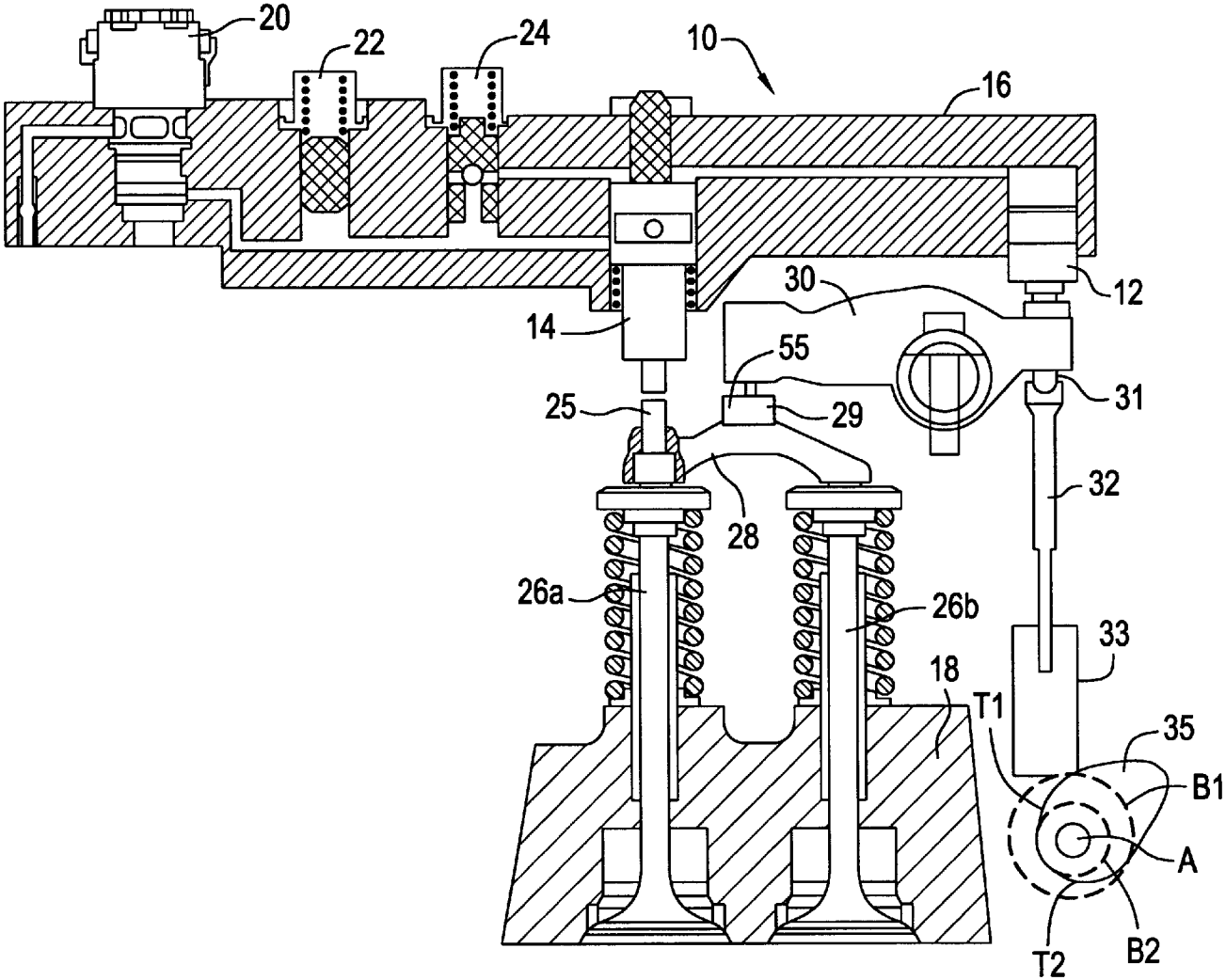
FIG. 1 is a schematic diagram of a compression relief engine braking system embodying the present invention.

A schematic diagram of an engine compression relief braking system, embodying the present invention, is shown in FIG. 1 of the accompanying drawings. The braking system comprises a reciprocable hydraulic circuit 10 comprising a primary cylinder 12 and a secondary cylinder 14 mounted in a block 16 which is secured to the engine cylinder head 18 of a compression ignition engine, not shown to simplify the discussion of the invention. A solenoid valve 20 controls the supply of hydraulic fluid to the circuit 10. When the circuit 10 is pressurised, the supply pressure is regulated by an accumulator 22 to a pressure sufficient to raise a control valve 24 into a position in which the pistons of secondary cylinder 14 follows the movements of the piston of the primary cylinder 12. When the hydraulic circuit is pressurised, the secondary cylinder 14 is arranged to open one of the exhaust valves 26*a* at the end of the compression stroke in order to actuate the engine brake. This is achieved by the secondary cylinder 14 acting on a pin 25 that is slidably received in the end of a crosshead 28 and pushes down directly on the stem of the exhaust valve 26*a*, which is shown to the left in FIG. 1.

The primary cylinder 12 can be biased by the pressure in the hydraulic circuit 10 to follow any element in the cylinder head that reciprocates with the appropriate phase. For example, the primary cylinder may follow the push rod of the injector for the same cylinder or a cam acting on valves of another cylinder in the block. Alternatively, it is possible to derive the motion of the primary cylinder from the exhaust cam of the same cylinder if the cam is suitably shaped. As shown in FIG. 1, crosshead 28 is of the floating type, i.e. one which does not have a fixed center post over which it slides. The crosshead is restrained from lateral movement because it has first and second recesses 27*a* and 27*b* which embrace the ends of valves 26*a* and 26*b*, respectively. Crosshead 28 has a central flat 29 which receives a first end of a rocker arm assembly 30, described in detail below. A second end of rocker arm 30 has an adjustable pin 31 which receives an upper end of a pushrod 32, extending to, and received in a cam follower 33. Cam follower 33 rests on a cam 35, journaled to be rotated about axis A. Cam 35 has a first base circle B1 and a second base circle B2 defining a smaller radius than B1. For illustration purposes, the difference is exaggerated. A lift profile L defines the portion of the cam which lifts the follower 33 to cause the exhaust valves 26*a* and 26*b* to open. Transition portions T1 and T2 define a transition between the base circle B1 to B2.

Figure 2:
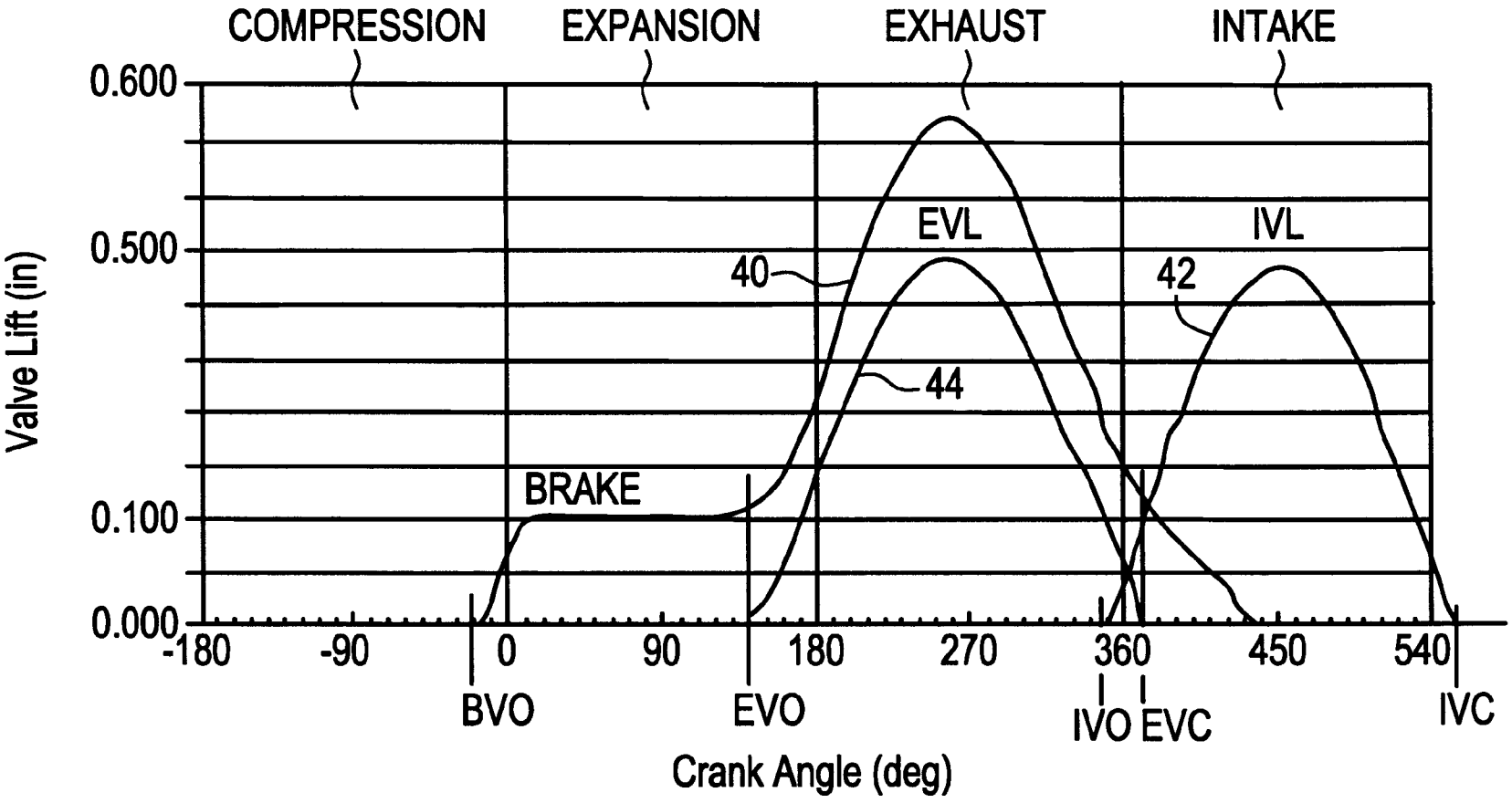
FIG. 2 is a graph representing the inlet and exhaust valve events during normal operation and when the compression engine braking system is actuated.

FIG. 2 of the accompanying drawings is a graph showing the cam lift of the inlet and exhaust valves plotted against the crank angle. The profile of the exhaust cam illustrated in FIG. 1 corresponds to the curve 40 in the drawings while that of an inlet cam(not shown) is represented by the curve 42. The letters indicated on the drawings are defined as follows:

| Term | Definition |
|---|---|
| BVO | Brake valve opening |
| EVO | Exhaust valve opening |
| EVL | Exhaust valve maximum lift |

-continued

| Term | Definition |
|---|---|
| IVO | Intake valve opening |
| EVC | Exhaust valve closing |
| IVL | Intake valve maximum lift |
| IVC | Intake valve closing |

During normal engine operation, however, the exhaust valves 26*a* and 26*b* do not follow the entire movement of the exhaust cam 35 because lost motion is intentionally introduced into the train transmitting the movement of the cam surface to the exhaust valves through the use of base circles B1 and B2. As a result of the lost motion, the first 0.1" (2.5 mm) of movement of the push rod has no effect on the valves and merely takes up the lost motion, or lash, in the transmission train. This lash is generally equal to the difference between the radiuses of the base circles B1 and B2. Thereafter, the exhaust valves open at EVO with a lift represented by the curve 44 in FIG. 2.

When the compression brake is actuated, on the other hand, the primary cylinder 12 is brought by the pressure in the hydraulic circuit 10 out of a retracted position (into which it is urged by a spring that is not shown) into contact with the rocker 30. As a result, the primary cylinder follows the full movement of the push rod 32 and the surface of the exhaust cam along base circle b2 through transition portions T and transmits this movement hydraulically to the secondary cylinder 14. The latter then acts directly on one of the exhaust valves and it is lifted at BVO to follow the full contour of the exhaust cam 35, that is to say the curve 40 in FIG. 2.

Hence it can be seen that when the hydraulic circuit is not pressurised the exhaust valve timing is normal, with the exhaust valve opening (EVO) and the exhaust valve closing (EVC) of both exhaust valves taking place at the start and end of the exhaust stroke, respectively. On the other hand, once the solenoid valve 20 is actuated to pressurise the hydraulic circuit, the exhaust valve 26*a* acted upon by the secondary cylinder 14 opens at the brake valve opening (BVO) instant and remains open during the expansion stroke of the four stroke cycle.

A problem encountered with such an engine is that the amount of lash required in the transmission train from the exhaust cam to the exhaust valves is significantly larger than normal. Aside from the usual noise and wear problems that such excessive free play can cause, there is a risk of the rocker 30 separating completely from the crosshead 28. To prevent such separation of the crosshead 28 from the heads of the valves 26*a* and 26*b* a lash adjuster, generally indicated at 55, is provided.

Figure 3:
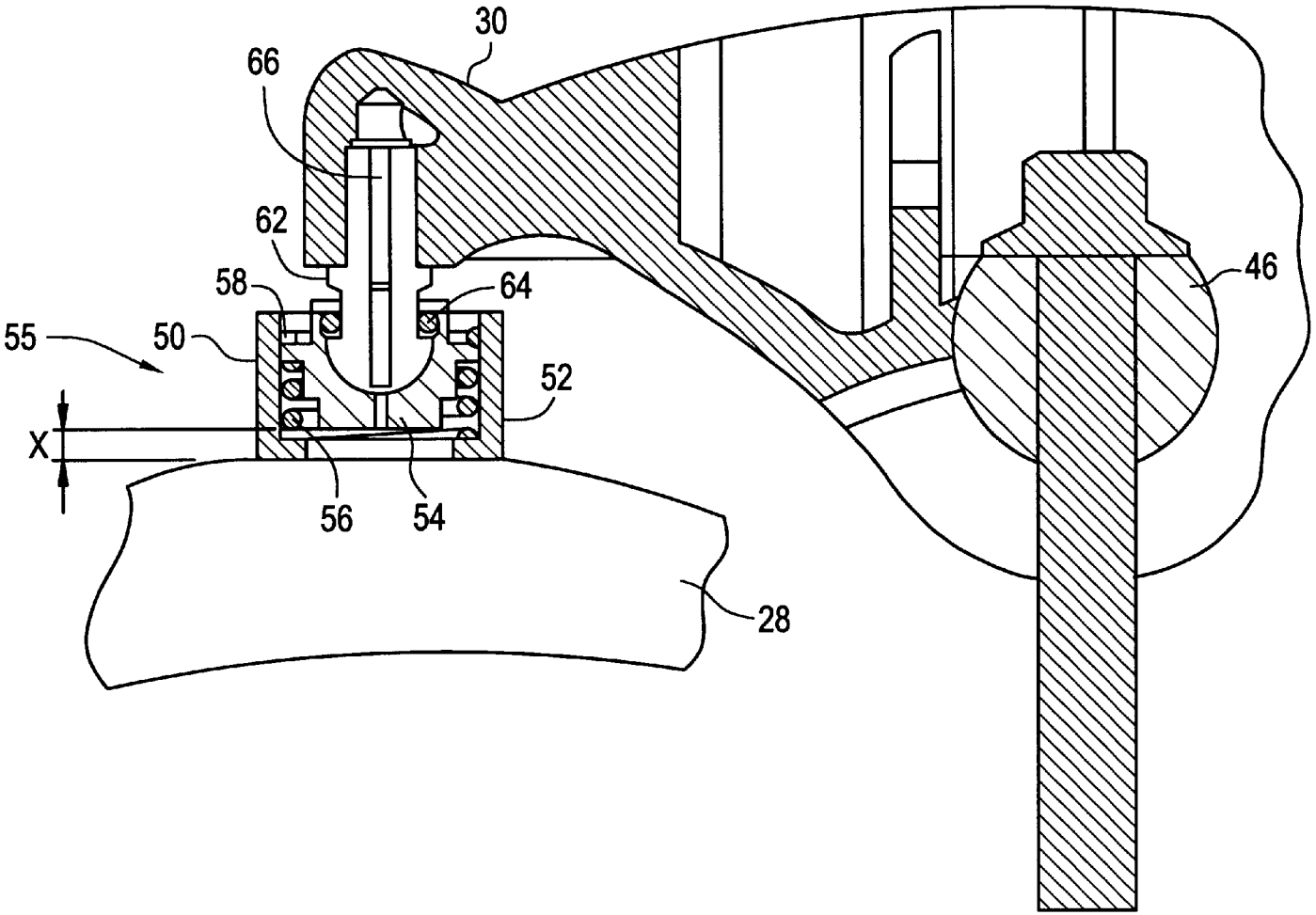
FIG. 3 is a detail of an embodiment of the invention showing a lash adjuster arranged between the rocker and the crosshead.

FIG. 3 shows a section of the rocker arm 30 which is pivotable about a rocker shaft 46. The drawing only shows the first end that acts on the crosshead 28. The rocker 30 is fitted with a ball headed stud 62 onto which there is attached the inner member 54 of a lash adjuster by means of an O-ring 64. The lash adjuster includes an outer cup 50 which acts on the flat 29 formed on the crosshead 28. The inner member 54 is retained within the cup 50 by means of a circlip 58 that is received in a groove in the inner surface of the cup 50. A spring 56 acts between the base of the cup 50 and a flange projecting from the inner member 54 to urge the inner member upwards as viewed away from the crosshead 28 and against the stop presented by the circlip 58.

In normal operation of the engine, when the end of the rocker 30 moves downwards as viewed, it does not directly on the crosshead but on the inner member 54 of the lash adjuster. The latter moves with the rocker 30 at all times but does not commence to act on the crosshead 28 until the free play or lost motion X is taken up. Hence the exhaust valves do not open at the instant designated BVO in FIG. 2 but at the instant designated EVO, corresponding to normal exhaust valve timing.

When the compression braking system is actuated, during the expansion stroke the secondary cylinder 14 acts on the exhaust valve 26*a* through the pin 25 to open the exhaust valve 26*a*. During this time, the crosshead 28 and the other exhaust valve 26*b* do not move and the pin 25 slides inside the crosshead 28 as the movement of the rocker 30 is taken up by the lash adjuster 55. The crosshead 28 nevertheless remains firmly in position as it is held against lateral movement by the lash adjuster 55 and is prevented from rotating about the lash adjuster by the pin 25. The need for a locating peg or slider to restrict the movement of the centre of the crosshead 28 is therefore obviated in the present invention.

It should be noted that the stiffness of the spring must be great enough to maintain contact with the crosshead at all times during the rotation of the cam 35, but not so stiff that it causes lift of actuation of the exhaust valves when lift is not commanded. It should also be noted that a passage 66 in stud 62 provides a path for lubricant to minimise wear of the joints.

Having thus described the invention, what is novel and desired to be secured by Letters Patent of the United States is:

1. A compression relief engine braking system for an engine having two exhaust valves per cylinder, a crosshead in contact with both exhaust valves, a rocker arm arranged in the drive train between an exhaust cam and the crosshead, one end of the rocker arm acting on a point on the crosshead lying between the exhaust valves and the other end of the rocker arm being arranged to follow the surface of the exhaust cam, the braking system comprising a hydraulic primary piston arranged in a hydraulic circuit with a secondary cylinder acting on one of the exhaust valves, the primary cylinder being biased by a spring away from said other end of the rocker arm when the compression brake is inactive and being biased by the pressure in the hydraulic circuit to move with said other end of the rocker when the compression brake is active, characterised in that a spring biased lash adjuster is arranged between said one end of the rocker arm and the crosshead.

2. A compression relief engine braking system as claimed in claim 1, wherein said spring biased lash adjuster comprises an outer cup acting on one of said rocker arm and said crosshead, an inner member connected for movement with the other of said elements, the inner member being held captive within the outer cup and being free to effect a limited displacement relative to the outer cup, and a spring arranged within the cup and acting on the inner member to bias the inner member and outer cup to an elongated position to maintain contact with said crosshead and said rocker arm.

3. A compression relief engine braking system as claimed in claim 2 wherein said spring has sufficient stiffness to maintain contact between said crosshead and said rocker arm throughout the movement of the exhaust cam and not enough stiffness to cause lift of said one of the exhaust valves when lift is not commanded by the exhaust cam.

4. A compression relief engine braking system as claimed in claim 2 wherein said inner member is connected to said rocker arm.

5. A compression relief engine braking system as claimed in claim 4 wherein said inner member comprises:

a stud threaded into said rocker arm, and having a convex end;

an inner element having a concave recess for receiving the convex end of said stud, said inner member being received in said outer cup; and a clip for removeably retaining said convex end of said stud in the concave recess of said inner element.

6. A compression relief engine braking system as claimed in claim 5 wherein:

said inner element further comprises a flange closely adjacent to the outer cup;

said outer cup has an inwardly directed shoulder and said spring acts between the flange on said inner element and said shoulder.

7. A compression relief engine braking system as claimed in claim 6 further comprising a clip received in said outer cup for releaseably retaining and limiting displacement of said inner element.

8. A compression relief engine braking system as claimed in claim 7 wherein said outer cup has an opening defined by said shoulder and said inner element has a section which is displaceable to protrude through said opening, thereby minimizing the overall height of said lash adjuster.

9. A compression relief engine braking system as claimed in claim 5 further comprising means for forming passages in said rocker arm and said threaded stud for lubricant to be supplied to the interface between the convex end of said stud and the concave recess of said inner element.

10. A compression relief exhaust braking system as claimed in claim 9 wherein said spring has sufficient stiffness to maintain contact between said crosshead and said rocker arm throughout the movement of the exhaust cam and not enough stiffness to cause lift of said one of the exhaust valves when lift is not commanded by the exhaust cam.

* * * * *